US005687911A

United States Patent [19]

Boakye-Danquah et al.

[11] Patent Number: 5,687,911

[45] Date of Patent: Nov. 18, 1997

[54] MULTIDIRECTIONAL FOAM AEROSOL DISPENSING

[75] Inventors: Michael Boakye-Danquah, Hazelwood; John F. Pysz, Crestwood; Floyd R. French, Manchester; Joseph C. Lott, St. Louis, all of Mo.

[73] Assignee: Clayton Corporation, Fenton, Mo.

[21] Appl. No.: 388,209

[22] Filed: Feb. 18, 1995

[51] Int. Cl.[6] ..... B05B 7/24; B05B 7/26; B05B 7/32

[52] U.S. Cl. ..... 239/337; 239/340; 239/347; 239/372; 239/374

[58] Field of Search ..... 222/190, 635; 239/343, 347, 348, 337, 340, 372, 374

[56] References Cited

U.S. PATENT DOCUMENTS

| | | | |
|---|---|---|---|
| 3,830,760 | 8/1974 | Bengtson . | |
| 4,019,657 | 4/1977 | Spitzer et al. | 222/136 |
| 4,258,140 | 3/1981 | Horacek et al. . | |
| 4,429,814 | 2/1984 | Scotti et al. | 222/402.13 |
| 4,508,853 | 4/1985 | Kluth et al. . | |
| 4,558,073 | 12/1985 | Kluth et al. . | |
| 4,667,855 | 5/1987 | Holleran | 222/152 |
| 5,027,986 | 7/1991 | Heinzel et al. | 222/402.24 |
| 5,125,546 | 6/1992 | Dunne et al. | 222/394 |

OTHER PUBLICATIONS

Handbook of Aerosol Technology Second Edition Sanders, 1987 pp. 102–107.

The Aerosol Handbook, Johnson, 2nd Edition, p. 169–172.

Product Label from 12oz Can of Great Stuff, Manufactured by Insta–Foam Products, Inc.

*Primary Examiner*—Jeffrey C. Mullis

*Attorney, Agent, or Firm*—Neal Kalishman

[57] ABSTRACT

A method and system for dispensing a nonaqueous foam under pressure from a container wherein the valve of the container is pointed above the horizontal plane.

3 Claims, No Drawings

MULTIDIRECTIONAL FOAM AEROSOL DISPENSING

FIELD OF THE INVENTION

The invention relates to the dispensing of foams from pressurized containers. More particularly, the invention relates to the multidirectional dispensing of foam products from an aerosol container.

BACKGROUND OF THE INVENTION

Foams, such as, one component moisture cure urethane prepolymers are usually dispensed by pressurized containers. These containers have a foam valve on their mouth. The foam valve is a tilt actuated valve. As noted in Handbook of Aerosol Technology and The Aerosol Handbook, foam prepolymers are dispensed by inverting the can and toggling the valve.

Dispensing the prepolymer by inverting the can is the traditional way of forming a foam. The actual foam forms in the stem of the valve as the pressure on the liquefied gas equalizes to allow boiling and the formation of a gas which not only serves as a propellant but as a cell forming blowing agent. Instead of inverting the can a dip tube can be attached to the bottom of the valve to draw prepolymer from the bottom of the can.

It is believed in the industry that by opening the foam valve in the upright position or by turning the container upright from inverted during dispensing, the head gas will escape. This will cause the gas in the prepolymer to boil out without the expulsion of the prepolymer. Thus, rendering the dispensing system useless since product is not dispensed.

Dispensing foam or other aerosol products in the inverted position is awkward. It would be highly desirable to dispense aerosol products with the top of the can upward in order to maximize control. An upright dispensing system is more natural and more acceptable to consumers.

SUMMARY OF THE INVENTION

A method of dispensing from an aerosol container a nonaqueous foam under pressure through a foam valve which comprises pointing the valve opening above the horizontal plane while toggling the valve. As the product is discharged a preform is formed with in the container. The prepolymer system has a flow rate in the upright position of at least 400 grams/minute and at least 90% of the prepolymer is expelled in less than one minute.

DESCRIPTION OF THE INVENTION

The typical aerosol container for dispensing nonaqueous foams utilizes a conventional foam valve mounted on the mouth of the container. Inside the container is the prepolymer and the blowing agent. Above the prepolymer is a gas layer which is in equilibrium with the gas that is within the prepolymer.

The prepolymer usually contains an isocyanate, polyol, flame retardant, surfactant, catalyst, plasticizer, and propellant/blowing agent. The isocyanate is the "A" material and the Polyol with the flame retardant, surfactant, catalyst, and plasticizer is the "B" material. The formulas for one component moisture cure foams are well known as illustrated by U.S. Pat. Nos. 3,830,760; 4,508,853; 4,258,140; and 4,558,073 all of which are incorporated by reference herein. The propellant/blowing agent is usually a hydrocarbon or a hydrochlorofluorocarbon, such as, HCFC-22. The difference in the percentage by weight between the isocyanate material "A" and the polyol blend "B" is preferably no greater than 6% which compares to an approximate 10% difference in the conventional formulations. This percentage difference is a function of the formulation and the same result can be achieved by varying other components and thereby obtain a difference greater than 10%.

As a preferred embodiment the following conventional and improved formulations are provided:

| HCFC-22 FORMULATIONS | | |
|---|---|---|
| | CONVENTIONAL | NEW |
| B-BLEND | | |
| Polyol | 75.00 | 69.00 |
| Flame Retardant | 22.00 | 27.00 |
| Surfactant | 2.00 | 3.00 |
| Catalyst | 1.00 | 1.00 |
| TOTAL | 100.00 | 100.00 |
| FINAL BLEND | | |
| Isocyanate | 44.8 | 36.4 |
| B-Blend | 32.2 | 35.6 |
| Propellant/ Blowing Agent | 23.0 | 28.0 |
| TOTAL | 100.0 | 100.0 |
| HYDROCARBON FORMULATIONS | | |
| B-BLEND | | |
| Polyol | 68.00 | 69.00 |
| Flame Retardant | 30.00 | 27.00 |
| Surfactant | 1.00 | 3.00 |
| Catalyst | 1.00 | 1.00 |
| Total | 100.0 | 100.0 |
| FINAL BLEND | | |
| Isocyanate | 47.0 | 43.4 |
| B-Blend | 37.7 | 41.6 |
| Propellant/ Blowing Agent | 15.3 | 15.0 |
| Total | 100.0 | 100.0 |

It has been discovered that aerosol nonaqueous foam products can be dispensed when the can is in the upright position. This is true whether the initial dispensing occurs when the can is in either the downward or the upright position. If the dispensing is commenced with the can in the upright position, then a burst of gas will be initially observed. It was conventionally believed that all of the gas will be lost from the can, however, it has been found that as the gas escapes a prefoam is formed within the can. The forming of a prefoam also occurs with a dip tube valve system when the can is inverted. However, such a system is only effective when a very short dip tube is used.

It is seen that conventional formulas when in the upright position have substantially slower flow rates. It has been found that by adjusting the formula, the flow rates of the conventional formulas which are designed for dispensing in the inverted position can be achieved in an upright dispensing system.

We claim:

1. The method of dispensing from an aerosol container, without a dip tube, a nonaqueous foam under pressure through a toggle actuated foam valve comprising:

a) pointing the valve opening upward by positioning the container in an upright position while toggling the valve; and b) initially discharging a burst of gas followed by the discharging of a foam product.

2. The method of claim 1 wherein the said valve is mounted directly on the container.

3. The method of claim 1 wherein said foam comprises a one component moisture cure polyurethane.

* * * * *